United States Patent [19]

Owens, Jr.

[11] 4,082,098

[45] Apr. 4, 1978

[54] FLAVORED CIGARETTE

[75] Inventor: William F. Owens, Jr., Pisgah Forest, N.C.

[73] Assignee: Olin Corporation, Pisgah Forest, N.C.

[21] Appl. No.: 736,421

[22] Filed: Oct. 28, 1976

[51] Int. Cl.[2] ..... A24D 1/02; A24D 1/04

[52] U.S. Cl. ..... 131/9; 136/15 B; 131/10 A

[58] Field of Search ..... 131/261 A, 261 R, 9, 131/10 R, 10 A, 103, 10.7, 10.9, 11, 12, 144, 8, 158; 128/200, 207, 208, 187, 259

[56] References Cited

U.S. PATENT DOCUMENTS

| | | | |
|---|---|---|---|
| 3,410,274 | 11/1968 | Davis | 131/10 A |
| 3,625,224 | 12/1971 | Leffingwell | 131/261 A |

FOREIGN PATENT DOCUMENTS

| | | | |
|---|---|---|---|
| 304,351 | 1/1969 | Canada | 131/10 R |

OTHER PUBLICATIONS

*Tobacco Flavoring for Smoking Products* by Leffngwell et al., Pub. by R. J. Reynolds Tobacco Co. in 1972, Winston-Salem North Carlolina, p. 17 cited.

*Primary Examiner*—Kyle L. Howell
*Assistant Examiner*—V. Millin
*Attorney, Agent, or Firm*—Robert W. Habel

[57] ABSTRACT

A ventilated cigarette uniquely designed to introduce volatile flavoring agents such as menthol into the mainstream smoke of the cigarette with improved delivery rate and longer shelf life for the flavoring agent. The cigarette has a porous or perforated air permeable wrap encircling the filter plug impregnated with the volatile flavoring agent, enclosed in a perforated or inherently porous air permeable tipping envelope. As the cigarette is smoked, air is drawn through the ventilation area of the tipping, through the flavor-impregnated filter plug wrap and into the filter carrying the volatile flavoring agent with it where it mixes with the smoke, thereby imparting flavor to the cigarette smoke. Since the flavor-impregnated plug wrap is tightly enclosed between the tipping envelope and filter plug, loss of the volatile flavoring agent is minimized, thereby enabling longer shelf life without reduction in flavor potency. Moreover, high delivery rates are achieved using minimum amounts of flavoring agent.

5 Claims, 4 Drawing Figures

FLAVORED CIGARETTE

BACKGROUND OF THE INVENTION

This invention relates generally to flavored cigarettes and more particularly to a ventilated filter cigarette designed to impart a volatile flavoring agent into the cigarette smoke.

Mentholated cigarettes have been known for many years. Conventionally, they are made by spraying a menthol/alcohol solution onto the tobacco used to make up the cigarette. When such cigarettes are smoked, the menthol volatilizes and enters the mainstream smoke imparting flavor to the cigarette. One disadvantage of any system in which menthol is applied to the tobacco is that much of the taste effect of the menthol is lost in the sidestream smoke of the cigarette as the tobacco burns with only a small percentage entering the mainstream smoke. As a result, excessive amounts of menthol must be applied to the tobacco in order to achieve a satisfactory taste effect. Furthermore, much of the menthol is lost to the atmosphere during the spraying application, which is the only practical way of applying it to the tobacco. Another related disadvantage is that during storage and distribution of the cigarettes, a large percentage of the volatile menthol is lost from the tobacco through the package, thereby limiting the effective shelf life of the product.

Alternate methods have been attempted to impart flavor to cigarettes, such as disclosed in U.S. Pat. Nos. 3,236,244 and 3,972,335, wherein various carbon or silica gel materials are impregnated with menthol and the resulting material used as the filter element in a cigarette. While these techniques provide some advantages over use of menthol in tobacco, they still leave much to be desired, particularly insofar as delivery of the flavoring agent during smoking of the cigarette, and minimal use of flavoring agent in order to obtain a satisfactory taste in the final cigarette product.

Various types of ventilated cigarettes are also well known, such as the many examples disclosed in U.S. Pat. No. 3,805,800. However, heretofore the only known method of flavoring such ventilated cigarettes was by the above prior methods with their inherent disadvantages.

SUMMARY OF THE INVENTION

Accordingly, an object of this invention is to provide a cigarette containing a volatile flavoring agent such as menthol having improved delivery rates and longer shelf life for the flavoring agent with minimum amounts of flavoring agent required to produce the desired taste effect.

Surprisingly, we have discovered that using the filter plug wrapper as the carrier base for volatile flavoring agents such as menthol in a ventilated filter cigarette results in a smooth high delivery rate of the flavoring agent to the smoke while permitting longer shelf life for the product after manufacture and packaging. In accordance with this invention, a very small amount of volatile flavoring such as menthol dissolved in methanol, ethanol or other appropriate solvent is applied to air permeable plug wrap, which may be either inherently porous or perforated paper, using a roll coater, sprayer or other conventional applicator means. The flavor-impregnated plug wrap is then used to wrap a standard filter plug such as cellulose acetate and the combination made up into cigarettes employing a ventilated tipping envelope. The tipping envelope also may be either inherently porous tipping paper or perforated tipping paper, so long as it is ventilated in an area or areas overlying the flavor-impregnated air permeable plug wrap. When the resulting cigarettes are smoked, air is drawn through the ventilated area of the tipping envelope and through the flavor-impregnated plug wrap into the filter, where it mixes with the smoke. As the air passes through the plug wrap, it carries the volatile flavoring agent with it, thereby uniformly flavoring the cigarette smoke. The plug wrap is tightly enclosed between the filter plug and the encircling tipping envelope which are adhered together over preselected areas of their contiguous surfaces such that in the case of perforated tipping, the area of perforations is not adhered and in the case of inherently porous tipping, a band or other selected area or areas is left unadhered to allow ambient air to be drawn through the tipping and into the flavored plug wrap. Since the plug wrap is fully enclosed, loss of the volatile flavorant is greatly minimized compared to conventional mentholated cigarettes during storage of the cigarette enabling greatly extended shelf life for the product. Furthermore, due to the unique absorptive capability of the paper plug wrap as a carrier base for the flavoring agent, it readily releases the flavor as air is drawn through it, thereby imparting high delivery rates of flavor to the cigarette smoke with a minimum of flavorant required to achieve the desired taste. This is especially important where expensive volatile flavorants are employed. In addition and contrary to the conventional methods of flavoring cigarettes by spraying the volatile flavorant on the tobacco which results in excessive loss of the flavorant during the application as well as during manufacture, packing, and storage of the cigarette, according to the invention the flavoring agent can be conveniently applied to the plug wrap carrier by various means such as printing, spraying, and coating, thereby greatly minimizing loss of the flavorant to the atmosphere as is encountered with tobacco spraying. After applying the flavorant, the paper plug wrap can be used directly in the manufacture of cigarettes or it can be stored in wrapped rolls or bobbins indefinitely without substantial loss of flavorant to the atmosphere.

BRIEF DESCRIPTION OF THE DRAWING

In order that the invention may be more readily understood and carried into effect, reference is made to the accompanying drawing, which is offered by way of example only and not in limitation of the invention, the scope of which is defined by the appended claims rather than the description preceding them.

In the drawing.

DETAILED DESCRIPTION OF THE PREFERRED EMBODIMENTS

Figure 1:
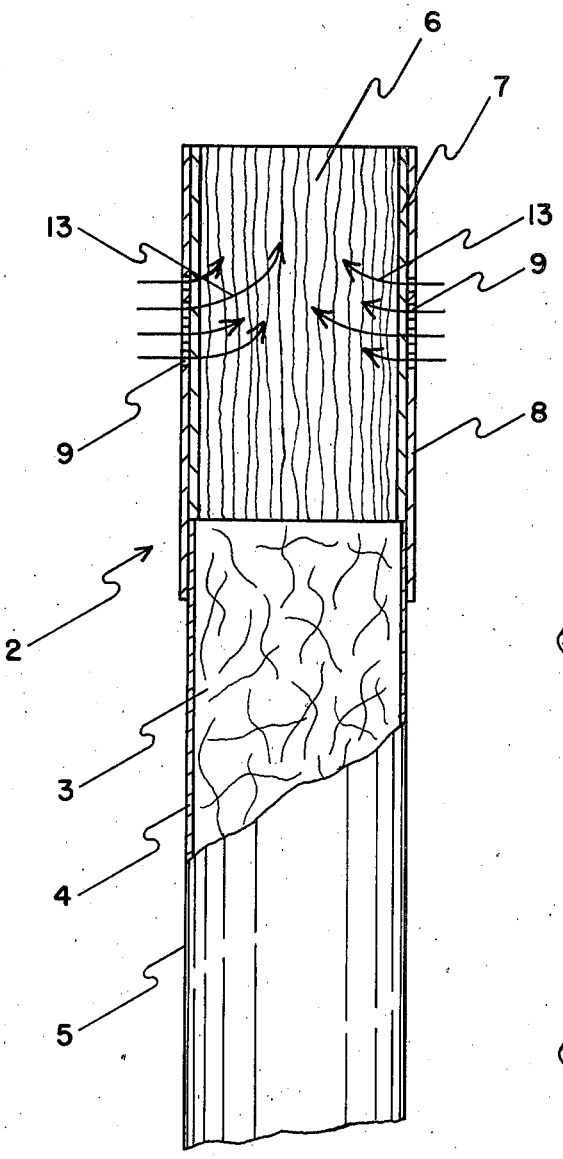
FIG. 1 is a schematic view of a cigarette partly in section showing one embodiment of the invention using perforated tipping.
Figure 3:
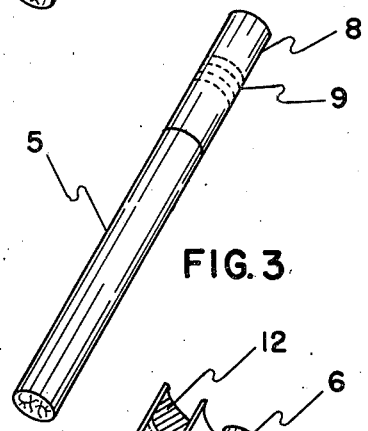
FIG. 3 is a perspective view of the cigarette of FIG. 1.
Figure 2:
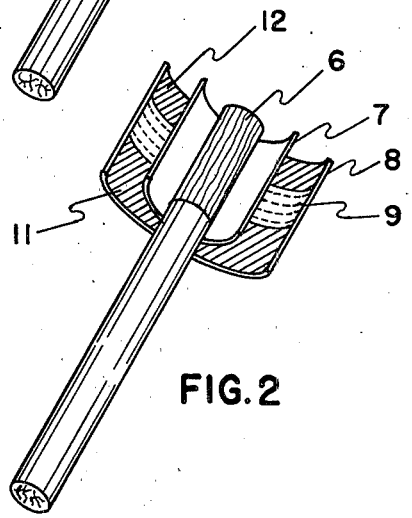
FIG. 2 is a perspective view of the cigarette of FIG. 1 showing the tipping section exploded and the relationship between the porous plug wrap and tipping envelope.

The present invention is based upon the discovery that the porous or perforated paper filter plug wrap in a ventilated cigarette can be used as the carrier base for volatile flavoring agents such as menthol resulting in a flavored cigarette having a high delivery rate of the flavorant to the cigarette, with minimum amounts of flavorant required and a longer shelf life for the product when compared to conventional flavored cigarettes. Referring to the drawing, FIG. 1 depicts a sectional view of the mouth end of a cigarette according to the invention, generally designated 2, comprising tobacco 3, wrapped in cigarette paper 4, thus forming a tobacco column 5 affixed to an abutting filter plug 6. The filter plug 6 may be made up of any of the conventional materials used for cigarette filters such as fibrous tows of cellulose acetate, cotton, wool and the like or paper crimped and folded in rod shape and cut to the desired plug length. An air permeable porous or perforated paper plug wrap 7 encloses the filter. Such papers are either perforated with a multiplicity of small holes after manufacture or are inherently provided with uniform porosity in the paper-making process, as is well known in the art. Tipping envelope 8, having a band of small perforations 9, encircles the wrapped filter and a short section of the tobacco column 5. As shown more clearly in FIGS. 2 and 3, the unperforated areas 11 and 12 of the tipping envelope 8 have an adhesive applied to them, thereby attaching the contiguous surfaces of the tipping envelope 8 to the plug wrap 7 and the wrapped filter 6 to the tobacco column 5.

The air permeable paper plug wrap 7 is impregnated with a volatile flavoring agent such as menthol. Preferably, the menthol is dissolved in methanol or ethanol and applied to the paper by a roll coater, sprayer or other conventional means. Desirable solutions are 50–50 (by volume) methanol to alcohol and only so much of the solution is applied for the paper to be thoroughly and uniformly coated or impregnated. Of course, the concentration of methanol in the solution and amount applied to the paper will depend on the degree of flavor desired in the cigarette. Since the paper plug wrap is primarily comprised of cellulose fibers, it readily absorbs menthol and other flavorants from the alcohol solution. While the flavorant may be applied to the plug wrap paper at any time, best results and minimum losses of flavorant are achieved if the paper is impregnated on the filter rod machine prior to wrapping the filter media in the porous plug wrap. Alternatively, the paper can be impregnated in a separate converting operation by printing, coating, etc., or as it is unwound for slitting on the bobbin slitter.

In accordance with the invention, the volatile flavor-impregnated plug wrap paper 7 is positioned in the cigarette to obtain maximum benefit. Thus, as the cigarette is smoked, air is drawn through the perforations 9 in tipping envelope 8 shown diagrammatically by arrows 13, and passes through the air permeable plug wrap 7 releasing the volatile flavorant and carrying it into filter 6 where it mixes with the mainstream smoke of the cigarette. The flavor is thus transmitted to the smoker with a high degree of efficiency and without any lost to the sidestream smoke, as occurs when volatile flavorants are applied to tobacco. Furthermore, since the plug wrap is tightly enclosed between the tipping and filter plug, loss of flavorant to the atmosphere during storage of the product is substantially reduced.

Figure 4:
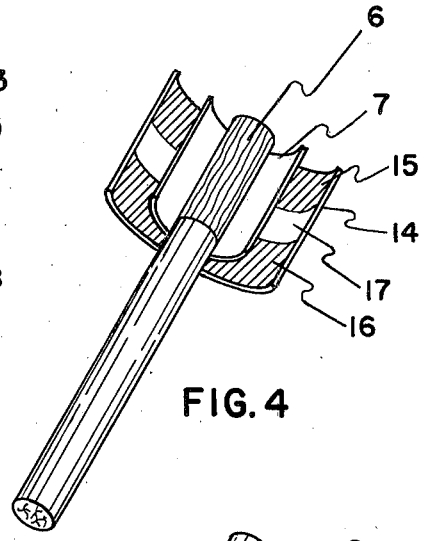
FIG. 4 is a view of a cigarette with the tipping section exploded showing another embodiment of the invention utilizing an ultraporous tipping envelope.

In FIG. 4, another embodiment of the invention is shown in which the tipping envelope 14 is made of uniformly porous tipping paper. Tipping envelope 14 encircles and is adhered to the plug wrap over preselected areas 15 and 16 of their contiguous surfaces so as to leave an adhesive-free region 17. Thus, in the finished cigarette, air is drawn through the adhesive-free region 17 of the porous tipping and through the flavor-impregnated plug wrap into the filter 6 where the flavor mixes with the cigarette smoke. Similar efficient and effective use of flavorants is obtained with this embodiment as with the embodiment shown in FIGS. 1–3. Control over the amount of flavorant released to the smoke can be maintained by the number of perforations in the tipping envelope as in the case of the embodiment shown in FIG. 1, the size of the adhesive-free area as in the embodiment of FIG. 4, the concentration of the flavorant in the plug wrap, or various combinations thereof. Thus, if the area of ventilation is small, lesser amounts of volatile flavorant will be released whereas if the ventilated area is large, the converse is true. Also, a high concentration of flavorant in the plug wrap will result in a higher transfer to the mainstream smoke.

The volatile smoke flavoring agent used in accordance with the invention may comprise any one or more of those used conventionally for the purpose of flavoring tobacco smoke. In addition to menthol, such flavorants as vanillin, spearmint oil, peppermint oil, and oil of cloves may be used singly or in various combinations. Therefore, the term "volatile flavoring agent" as used herein must be understood to include any volatile substance which enhances the taste of the smoke or is otherwise beneficial to the smoker.

It will be apparent from the foregoing that the ventilated cigarette of this invention provides a unique method of flavoring cigarette smoke without the inherent disadvantages present in flavored cigarettes of the prior art. Although the present invention has been described in conjunction with the preferred embodiments and drawings, the examples and description are only illustrative of the invention and it is to be understood that many variations and modifications may be resorted to without departing from the spirit and scope of the invention, as those skilled in the art will readily understand.

What is claimed is:

1. A flavored ventilated filter tip cigarette comprising a tobacco column and an abutting filter, said filter enclosed by an air permeable wrapper impregnated with a volatile smoke flavoring agent, a tipping envelope enclosing said enclosed filter having a ventilated area in communication with said wrapper, said envelope and wrapper being adhered together over regions of their contiguous surfaces but not over the ventilated area in said tipping envelope, said ventilated area being adhesive-free and air permeable permitting ambient air to flow therethrough and through said wrapper whereby volatile smoke flavoring agent is released from said wrapper and carried into said filter imparting flavor to the smoke from the cigarette.

2. The ventilated cigarette of claim 1 in which the ventilated area of said tipping envelope is provided by a multiplicity of discrete perforations disposed around said filter tip.

3. The ventilated cigarette of claim 1 in which the tipping envelope comprises inherently porous air permeable paper and the ventilated area is provided by leaving a preselected region of the contiguous surfaces of said wrapper and envelope adhesive-free.

4. The ventilated cigarette of claim 1 in which the ventilated area is disposed in a narrow band encircling the filter tip.

5. The ventilated cigarette of claim 1 in which the volatile flavoring agent is menthol.

* * * * *